US005392893A

United States Patent [19]

Murphy et al.

[11] Patent Number: 5,392,893

[45] Date of Patent: Feb. 28, 1995

[54] ADAPTER FOR COIN-OPERATED MACHINE

[76] Inventors: Ralph A. Murphy, P.O. Box 2434; David C. Collins, P.O. Box 1276, both of Gulf Shores, Ala. 36547

[21] Appl. No.: 988,335

[22] Filed: Dec. 9, 1992

[51] Int. Cl.[6] ..... G07F 1/04

[52] U.S. Cl. ..... 194/348

[58] Field of Search ..... 194/344, 347, 348, 349

[56] References Cited

U.S. PATENT DOCUMENTS 2,014,505 9/1935 Patche ..... 194/347 X 4,230,213 10/1980 Spring ..... 194/348

5,027,937 7/1991 Parish et al. ..... 194/348

*Primary Examiner*—F. J. Bartuska

*Attorney, Agent, or Firm*—James W. Hellwege

[57] ABSTRACT

An adapter for a coin-operated machine is mounted on the front face of the machine and covers the region for receiving coins. The adapter comprises a slot on the upper portion thereof and a tortuous passageway leading to the region for receiving coins. The tortuous path comprises a first downwardly and laterally extending segment having a liquid permeable bottom wall. Preferably, a second downwardly and laterally extending segment extends beneath the first segment, the second segment having a liquid impermeable roof.

6 Claims, 1 Drawing Sheet

ADAPTER FOR COIN-OPERATED MACHINE

The invention relates to the art of coin-operated machines, and more particularly to such machines having means for preventing liquids from reaching the coin handling and control mechanism and circuitry.

Modern coin-operated machines typically have electronic circuitry for determining the value of coins deposited in the machine and for controlling dispensing of the products being vended. In many such existing machines, pouring a conductive liquid such as salt water in through the coin slot damages or destroys the electronic circuitry, dumping the coins contained in the machine and, in some cases, dumping the products held for sale. Aside from the direct loss of the dumped coins and products, repair of a machine thus damaged costs several hundred dollars.

According to the invention, these and other disadvantages of the prior art are avoided by provision of an inexpensive adapter which may be readily added to such existing machines.

According to a first primary aspect of the invention, there is provided an adapter for a coin-operated machine having a front face comprising a region for receiving coins, the adapter comprising external housing means for covering the region, means for mounting the external housing means on the machine with the housing means extending along the front face from a location above the region to a position below the region, slot means in an upper portion of the housing means, the slot means being sized and adapted to receive coins, and guide means defining a tortuous path for the coins from the slot means to the region. The tortuous path comprises a first segment comprising a first bottom wall or floor leading diagonally downwardly and laterally in a first direction a distance greater than the width of the coins to a second segment, the first bottom wall having at least one liquid passage penetrating therethrough whereby a liquid introduced into the slot falls freely through the first bottom wall and is thereby diverted from the region.

According to another aspect of the invention, the second segment leads diagonally downwardly and laterally beneath the first segment, the second segment having a liquid-impermeable roof, whereby liquid flowing through the passage is prevented from entering the second segment.

According to another aspect of the invention, at least a portion of the second segment has a second bottom wall having at least one further liquid passage penetrating therethrough whereby liquid introduced into the second segment falls freely through the second bottom wall.

According to another aspect of the invention, the guide means in the vicinity of the region has liquid-impermeable top and side walls, the attachment further comprising means for sealing the top and side walls to the front face.

According to another primary aspect of the invention, there is provided a machine having a region for handling coins, the apparatus comprising inlet slot means for receiving coins and guide means defining a tortuous path for the coins from the slot means to the region. The tortuous path comprises a first segment comprising a first bottom wall leading diagonally downwardly and laterally in a first direction a distance greater than the width of the coins to a second segment, the first bottom wall having at least one liquid passage penetrating therethrough whereby a liquid introduced into the slot means flows freely through the first bottom wall floor and is thereby diverted from the region. The second segment leads diagonally downwardly and laterally beneath the first segment, the second segment having a liquid-impermeable roof, whereby liquid flowing through the at least one passage is prevented from entering the second segment.

According to another aspect of the invention, at least a portion of the second segment has a second bottom wall having at least one further liquid passage penetrating therethrough whereby liquid introduced into the second segment falls freely through the second bottom wall.

Other aspects will in part appear hereinafter and will in part be apparent from the following detailed description taken together with the accompanying drawings, wherein.

Figure 1:
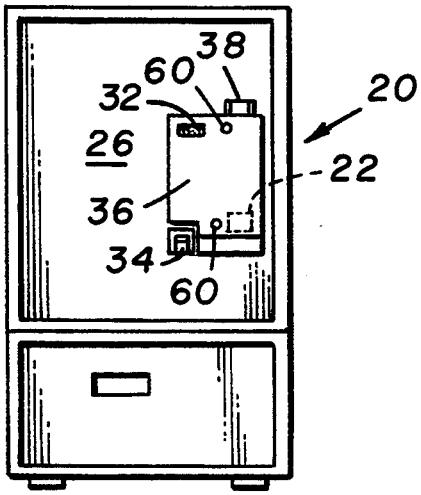
FIG. 1 is a schematic front elevation view of a typical conventional coin-operated machine, with the adapter of the invention installed and covering the region for receiving coins.
Figure 2:
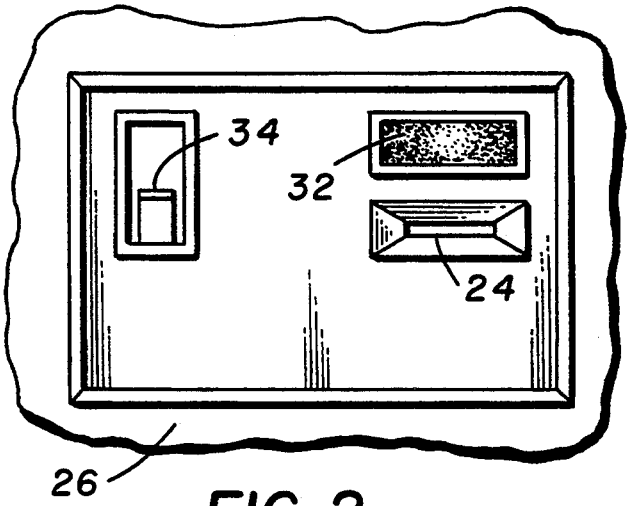
FIG. 2. PRIOR ART
FIG. 2 is a front elevation view of the region for receiving coins and the usual coin-return lever.

As illustrated in FIGS. 1 and 2, conventional coin-operated machine 20, which may be a vending machine, has region 22 for receiving coins comprising slot 24 on front face 26, region 22 being indicated in dotted lines in FIG. 1. The preferred embodiment of adapter 28 of the invention is attached to front face 26 of machine 20 in the position indicated, with its lower portion 30 covering region 22.

As illustrated in FIG. 2, the typical vending machine region 22 for receiving coins includes illuminable sign 32 near slot 24,, and coin-return lever 34 is usually positioned nearby.

Adapter 28 according to the invention comprises outer housing 36 mounted on front face 26. The original illuminable sign 32 is preferably removed from front face 26 and installed in the upper region of housing 36. Housing 36 is shaped so as to cover slot 24 and the original location of sign 32, but to not cover or interfere with normal usage of lever 34.

Adapter 28 comprises coin slot 38 in an upper region thereof together with guide means defining a tortuous path or passageway for the coins to region 22. The coins can be led to original slot 24 or, in some machines, to the aperture resulting from removal of sign 32. The tortuous path comprises a first segment comprising a first bottom wall or floor 40 leading diagonally downwardly and laterally in a first direction (to the left as viewed in FIG. 3) a distance greater than the width or diameter of the coins to a second segment. In the illustrated preferred embodiment, wall 40 is in the form of a series of horizontal rods or cylinders, the rods being laterally and vertically spaced as illustrated, thus providing between adjacent rods at least one liquid passage penetrating through wall 40 so that a liquid introduced into slot 38 flows freely through wall 40.

The preferred second segment leads diagonally downwardly and laterally beneath the first segment, and has a liquid impermeable roof 42. At least a portion of the second segment preferably has a bottom wall 44 similar to bottom wall 40. That is, a portion of the second segment has bottom wall 44 with one or more liquid passages penetrating therethrough so that a liquid introduced into the second segment falls freely through bottom wall 44.

Lateral opposed walls 46 and 48 support coin 50 in a vertical plane during the descent from slot 38 to the third segment of the coin passageway, during which coin 50 rolls on the transverse rods constituting bottom walls 40 and 44. Lateral walls 46 and 48 are spaced apart a distance somewhat greater than the thickness of coin 50.

Figure 3:
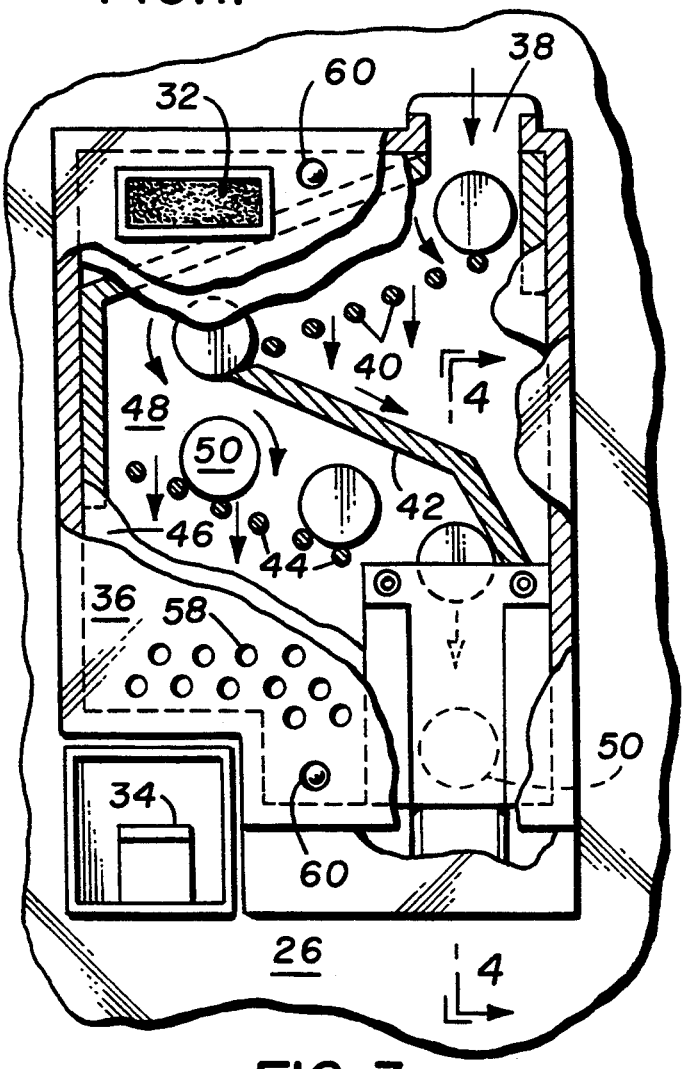
FIG. 3 is an enlarged front elevation of the adapter, partially broken away.
Figure 4:
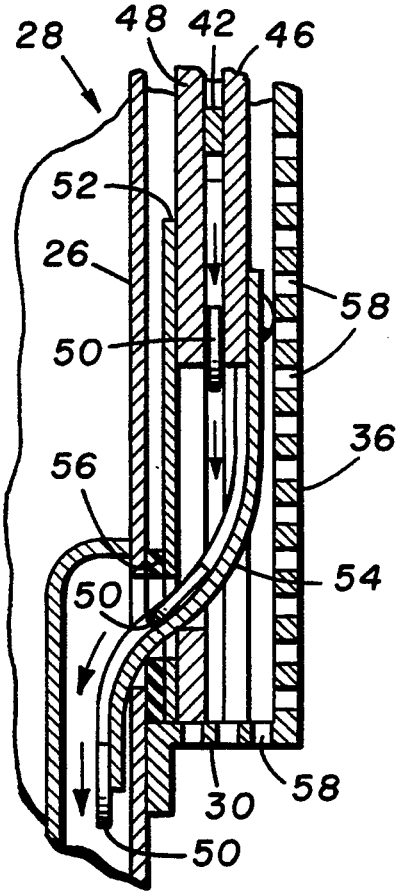
FIG. 4 is a vertical section taken along line 4—4 in FIG. 3.

The preferred third segment of the coin passageway will be described with reference to FIGS. 3 and 4. Planar plate 52 is attached to the rear surface of lateral wall 48, and extends downwardly past slot 24. Curved guide plate 54 is mounted on the front surface of lateral wall 46, and extends downwardly and rearwardly through an aligned slot in planar plate 52 and through slot 24. Accordingly, coin 50 after leaving the second segment of the passageway is guided by guide plate 54 through the slot in planar plate 52 and through slot 24. Gasket means 56 provides a seal around slot 24 between planar plate 52 and front face 26, thus preventing liquid from entering slot 24.

The liquid diverted from the coin passageway exits through a number of perforations 58 or the like formed in the sides and bottom of housing 36. The entire assembly as thus described is preferably mounted on front face 24 by carriage bolts 60 extending through the adapter and front face 26, the bolts being secured by nuts on the inner or rear surface of front face 26.

We claim:

1. An adapter for a coin-operated machine having a front face including a region for receiving coins, said adapter comprising:

(a) housing means for covering said region for receiving coins;

(b) means for mounting said housing means on said front face of said machine, with said housing means extending along said front face from a location above said region for receiving coins to a position below said region for receiving coins;

(c) slot means in said housing means, said slot means being sized to receive coins;

(d) coin guide means defining a tortuous path for directing coins received from said slot means to said region for receiving coins, said tortuous path comprising a liquid permeable first coin guide portion directing coins in a first direction diagonally downwardly and laterally a distance greater than the width of said coins to a second coin guide portion, said first coin guide portion having at least one liquid passage therethrough, said second coin guide portion directing coins received from said first coin guide portion in a second direction diagonally downwardly and laterally beneath said first coin guide portion; and (e) liquid diverter means positioned below said first coin guide portion to divert liquid passing through said first coin guide portion away from said region for receiving coins.

2. The adapter of claim 1 wherein said second coin guide portion contains at least one liquid passage therethrough.

3. The adapter of claim 1 wherein said liquid diverter means extends laterally above said second coin guide portion to prevent liquid passing through said first coin guide portion from passing downwardly to said second coin guide portion.

4. The adapter of claim 1 wherein said guide means in the vicinity of said region to receive coins has liquid-impermeable upper and side walls, and further comprising means for sealing said upper and side walls to said front face of said machine.

5. Apparatus for excluding liquids from a coin-operated machine having a region for handling and receiving coins, said apparatus comprising:

(a) inlet slot means for receiving coins;

(b) coin guide means defining a tortuous path for directing coins received from said slot means to said region for receiving coins, said tortuous path comprising a liquid permeable first coin guide portion directing coins in a first direction diagonally downwardly a distance greater than the width of said coins to a second coin guide portion, said first coin guide portion halving at least one liquid passage therethrough, said second coin guide portion directing coins received from said first coin guide portion in a second direction diagonally downwardly beneath said first coin guide portion and including at least one liquid passage therethrough; and (c) liquid diverter means below said first coin guide portion to divert liquid passing through said first coin guide portion away from said region for receiving coins.

6. The adapter of claim 5 wherein said liquid diverter means extends laterally above said second coin guide portion to prevent liquid passing through said first coin guide portion from passing downwardly to said second coin guide portion.

* * * * *